United States Patent [19]

Bassett

[11] 4,184,790

[45] Jan. 22, 1980

[54] SUBMERGED PILE GROUTING

[75] Inventor: Max Bassett, Houston, Tex.

[73] Assignee: C. Nelson Shield, Jr., Trustee, Houston, Tex.

[21] Appl. No.: 773,149

[22] Filed: Mar. 1, 1977

[51] Int. Cl.[2] ..... E02B 17/00; E02D 33/00

[52] U.S. Cl. ..... 405/225; 405/227

[58] Field of Search ..... 61/54, 86, 94, 98, 100, 61/102; 405/195, 225, 227

[56] References Cited

U.S. PATENT DOCUMENTS

| | | | |
|---|---|---|---|
| Re. 28,232 | 11/1974 | Bassett et al. | 405/227 |
| 1,013,758 | 1/1912 | Fox et al. | 405/216 |
| 1,084,063 | 1/1914 | Bignell | 405/237 |
| 1,729,422 | 9/1929 | Gleasner | 405/233 |
| 1,753,440 | 4/1930 | Miller | 166/315 |
| 2,412,185 | 12/1946 | Weber | 61/54 |
| 2,609,125 | 9/1952 | Schemm | 406/90 |
| 2,858,966 | 11/1958 | Pfening | 222/504 |
| 2,934,223 | 4/1960 | Scruby et al. | 222/482 |
| 3,011,547 | 12/1961 | Holbert et al. | 166/253 |
| 3,100,525 | 8/1963 | Smith et al. | 166/288 |
| 3,114,419 | 12/1963 | Perry et al. | 166/247 |
| 3,152,641 | 10/1964 | Boyd | 166/295 |
| 3,187,513 | 6/1965 | Guild | 405/233 |
| 3,196,946 | 7/1965 | Lauffer | 166/285 |
| 3,209,544 | 10/1965 | Borrmann | 405/208 |
| 3,213,629 | 10/1965 | Manning | 405/225 |
| 3,457,728 | 7/1969 | Pogonowski | 61/94 |
| 3,492,824 | 2/1970 | Evans et al. | 405/303 |
| 3,533,241 | 10/1970 | Bowerman et al. | 61/86 |
| 3,564,856 | 2/1971 | Blount et al. | 61/94 |
| 3,597,930 | 8/1971 | Rochelle | 405/211 |
| 3,601,999 | 8/1971 | Olsen | 405/225 |
| 3,702,537 | 11/1972 | Landers | 61/98 |
| 3,811,289 | 5/1974 | Bassett | 405/225 |
| 3,832,857 | 9/1974 | Bassett | 405/225 |
| 3,878,687 | 4/1975 | Tragesser | 405/225 |
| 4,063,421 | 12/1977 | Coone et al. | 61/102 |
| 4,077,224 | 3/1978 | Coone | 61/94 |

FOREIGN PATENT DOCUMENTS

| | | |
|---|---|---|
| 23039 | 2/1906 | Austria . |
| 286333 | 4/1913 | Fed. Rep. of Germany . |
| 180901 | 2/1936 | Switzerland . |
| 674809 | 7/1952 | United Kingdom . |
| 1307181 | 2/1973 | United Kingdom . |

*Primary Examiner*—David H. Corbin
*Attorney, Agent, or Firm*—David M. Ostfeld

[57] ABSTRACT

Apparatus and method is disclosed for filling the annulus between the jacket and piling of members of cluster or pin piles with fluid grouting material. Cluster or pin piles surround and support a main leg can of an offshore rig. The main leg extends to the water surface and supports the platform of the rig. The cluster or pin piles terminate below the water surface. Each cluster or pin pile includes a hollow, cylindrically shaped jacket with a piling through it. A dual packer, comprising two, vertically separated packers is used to seal the jacket of the cluster or pin pile to the piling. An annular chamber is formed between the two packers. Dual lines provide fluid flow communication between the annular chamber and apparatus located at the water surface. The apparatus at the water surface uses the dual lines to exhaust water from the annular chamber and set the packers. These dual lines also are used by the apparatus to test the integrity of the seal of the packers with the jacket and the piling, and fill the annular chamber with liquid grouting material, including when either of the packers does not form a seal with the piling or the jacket. The dual lines are additionally used to apply pressure to the fluid grouting material to aid in forming a bond between the fluid grouting material and the jacket and the piling. The method includes the steps of:

(a) setting the dual packer;
(b) introducing air to expel water from the annular chamber;
(c) testing the annular chamber to determine the integrity of the seal of the dual packer with the piling and the jacket;
(d) filling the annular chamber with fluid grouting material; and
(e) applying pressure to the fluid grouting material to aid in forming a bond between the fluid grouting material and the jacket and the piling.

35 Claims, 8 Drawing Figures

SUBMERGED PILE GROUTING

BACKGROUND OF THE INVENTION

1. Field of the Invention

This invention relates to the grouting of offshore structures.

2. Description of the Prior Art

Offshore structures or rigs have come into increasing use in recent years to support platforms for drilling of oil and gas wells and for producing oil and gas from such wells. Such structures may be erected in water from comparatively shallow depths up to several hundred feet deep. A variety of forms of structure and methods of construction of such platforms have been utilized. One such method which has been found to be particularly desirable in deep water is that which is illustrated, for example, in U.S. Pat. No. 3,209,544 to Borrmann, in which the legs of the structure are fabricated and assembled on shore. The legs are hollow, and may be sealed to make the structure buoyant, so that it can be towed out to the desired offshore location. Valves in the legs are opened to allow flooding with sea water, so that the leg structure will sink in a vertical position and settle onto the bottom. As the legs sink they fill with water up to the water level of the sea. It will be appreciated that the legs will sink into the ocean bottom a distance dependent upon the weight of the structure and the softness of the ocean bed.

A platform which is built only on such legs would have a high degree of instability, particularly in heavy storms. It has, therefore, been the practice to more rigidly connect the structure to the ground by driving hollow steel pilings down through the legs, which then become jackets for the pilings.

When the piling has been fully driven (usually to refusal), it has been the practice to fill the annulus between the piling and the jacket with a grouting material which solidifies in place. This increases the rigidity and, therefore, the strength of the structure by increasing the surface area and strength of the connection between the piling and the jacket. It also helps to keep out water so as to prevent corrosion of the piling.

Various methods have been utilized for grouting such structures. One method, as shown in the aforesaid Borrmann patent, for example, requires the use of a seal member at the bottom of the annulus. In this method the grouting material is pumped into the bottom of the annulus and rises upwardly therein to the top. This method usually requires the use of divers, and in addition, it often fails to produce fully satisfactory results because water cannot be effectively excluded from the annular space so that the grounting material becomes diluted and difficult to set.

Evans et al, in U.S. Pat. No. 3,492,824, describe a method comprising injecting air into the top of the annulus to expel water through a nipple at the bottom of the annulus, and then injecting grouting material through the bottom nipple. The grouting material is supposed to rise up through the annulus to above the water line, displacing air out the top. As a practical matter such a system would be very unsatisfactory. The ocean bed is normally soft and porous at the bottom of the jacket so that as soon as enough grouting material is pumped in to overcome the hydraulic head of the overlying sea water, the grouting material would begin to run out the bottom of the jacket and would be lost. Thus, it would be necessary to utilize some kind of seal or closure at the bottom of the annulus to hold the grouting in.

Evans et al also disclose a method whereby air is injected into the nipple at the bottom of the annulus to drive the water upwardly through the annulus out the top. It is apparent that such a system would be extremely inefficient in expelling water, since the air, being lighter, will rise up through the water. The same problem of losing grout out the bottom would also exist in this method.

Blount et al in British Pat. No. 1,307,181, issued Feb. 14, 1973, disclose another grouting system in which the grouting material is injected through nipples at the bottom of the annulus. Blount uses water to wash out mud from the location of Blount's injection nipples upwardly; but, Blount makes no attempt to remove water or mud from below the injection point. Furthermore, Blount's annulus is filled with water at the start, which must be expelled upwardly by the rising grouting material. Thus a large excess of grouting material would be necessary in order to insure that all of the water is expelled out of the top of the annulus.

Olsen and Bassett disclose, in their U.S. Pat. No. Re. 28,232, a reissue of U.S. Pat. No. 3,601,999, a system which avoids many of the problems encountered in other grouting systems. U.S. Pat. No. 3,832,857 to Bassett is an improvement over that system.

See also:

U.S. Pat. Nos.

1,013,758—Fox et al, issued Jan. 2, 1919, for "METHOD OF APPARATUS FOR APPLYING PROTECTING COVERING TO PILES:"

1,084,063—Bignell, issued Jan. 13, 1914, for "MEANS FOR FORMING UNDERGROUND FOOTING FOR PILES AND CAISSONS:"

1,729,422—Gleasner, issued Sept. 24, 1929, for "METHOD OF CLEARING AND FILLING TUBULAR PILES FOR FOUNDATIONS;"

1,753,440—Miller, issued Apr. 8, 1930, for "METHOD OF DRILLING WELLS IN GAS FORMATIONS;"

3,011,547—Holbert et al, issued Dec. 5, 1961, for "METHOD OF PREVENTING LOSS OF GASEOUS DRILLING FLUID;"

3,100,525—Smith et al, issued Aug. 13, 1963, for "CEMENTING:"

3,114,419—Perry et al, issued Dec. 17, 1963, for "METHOD FOR POLYMERIZING LIQUID RESIN-FORMING MATERIALS;"

3,152,641—Boyd, issued Oct. 13, 1964, for "METHOD FOR POLYMERIZING RESIN-FORMING MATERIALS IN SUBTERRANEAN AREAS;"

3,187,513—Guild, issued June 8, 1965, for "METHOD OF DRIVING PILES;"

3,196,946—Lauffer, issued July 27, 1965, for "AIR METHOD OF CEMENTING WELLS;"

3,213,629—Manning, issued Oct. 26, 1965, for "APPARATUS AND METHOD FOR INSTALLATION OF A PILE-JACKET ASSEMBLY IN A MARINE BOTTOM;"

3,597,930—Rochelle, issued Aug. 10, 1971, for "METHOD AND APPARATUS FOR REINFORCING IN SITUS IN PILE CASING;"

3,811,289—Bassett, issued May 21, 1974, for "METHODS OF GROUTING OF OFFSHORE STRUCTURES;" and 3,878,687—Tragesser, Jr., issued Apr. 22, 1975, for "GROUTING OF OFFSHORE STRUCTURES."

FOREIGN PATENTS

Austrian Pat. No. 23,039—Josef Vincent Brejcha, issued Feb. 10, 1906, for "FLUSH JOINT FOR BORE HOLES;"

Swiss Pat. No. 180,901—Eugene Frote, issued Feb. 1, 1936, for "PROCESS FOR THE CONSTRUCTION OF EXPANDED BASE PILES, CAST IN THE GROUND;"

German Pat. No. 286,333—August Wolfholz Preszzementbau, issued Apr. 1, 1913, for "PROCESS FOR CASTING CONCRETE PILES IN THE GROUND, BY MEANS OF A CASING AND COMPRESSED AIR;" and British Pat. No. 674,809—Lionel Ignacio Viera Rios, issued July 2, 1952, for "METHOD OF AND APPARATUS FOR SINKING CONCRETE, CEMENT OR THE LIKE PILES IN GROUND HAVING AN EXCESSIVE MOISTURE CONTENT".

The present invention of grouting is an improvement over the piror art patents for use with submerged piles for offshore rigs set in deeper water.

SUMMARY OF THE INVENTION

The present invention uses a highly effective method and apparatus for filling an annular chamber with fluid grouting material from apparatus located at the water surface. The chamber is formed between a submerged jacket and piling and bounded at its upper and lower end by a pair of packers. Dual flow lines are used for fluid flow communication between the surface apparatus and the annular chamber. The method includes setting the packers. It also includes introducing air or other process gas from the surface apparatus into the annular chamber via the dual flow lines to expel water from the annular chamber. The integrity of the seal of the packers with the jacket and the piling is tested through the process of setting the packers and introducing the air into the annular chamber. The procedure for introducing the fluid grouting material from the surface apparatus through the dual lines into the annular chamber is dependent on testing the integrity of the seal of the packers with the jacket and the piling. The annular chamber is then filled with grouting material from the surface apparatus through the use of the dual lines. Also, the grouting material introduced into the annular chamber may be subjected to increased pressure after filling to aid in forming a bond with the piling and the jacket.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DESCRIPTION OF THE PREFERRED EMBODIMENT

INTRODUCTION

The preferred embodiment of the present invention may be used to fill annular spaces with fluid grouting material wherein the annular space is entirely submerged. A particularly important area of the application of the present invention involves the grouting of submerged support pile structures, such as pin piles, for main legs of offshore rigs. A set of such pile structures is usually connected to the lower end of a hollow main leg of an offshore rig to structurally support the lower end of the leg. Each such pile structure comprises a hollow jacket with a pile driven through the center of the jacket, forming an annulus. Lower and upper packers are used to connect the jacket with the pile. The method and apparatus are used to fill the submerged annular space formed by the pile, the jacket and the pair of packers with fluid grouting material.

However, it should be realized that the present invention could be applied to, for example, any offshore structure wherein grouting is to be accomplished in an annulus between two sealed positions.

STRUCTURE AND ITS METHOD OF USE

Figure 1:
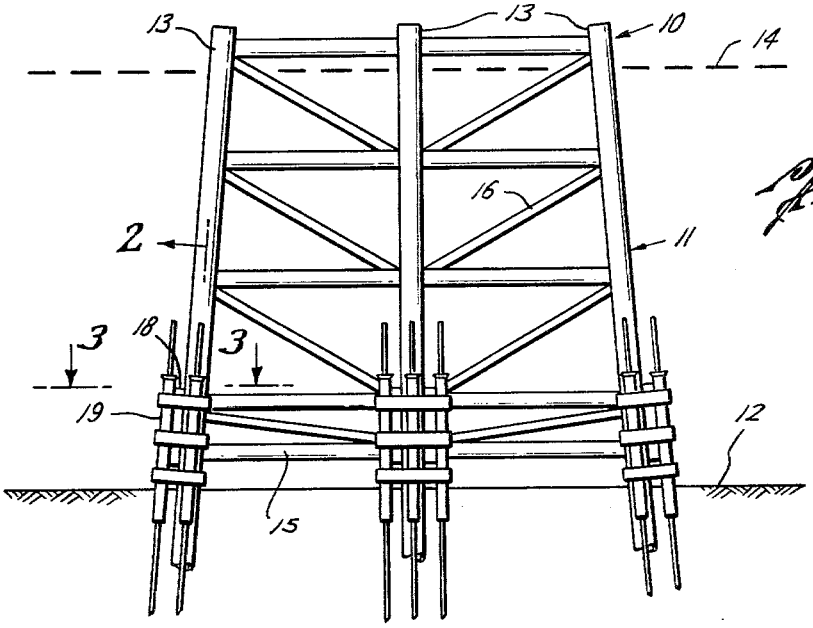
FIG. 1 is an elevational view showing a typical pin pile installation of legs of an offshore rig on the sea bed.
Figure 2:
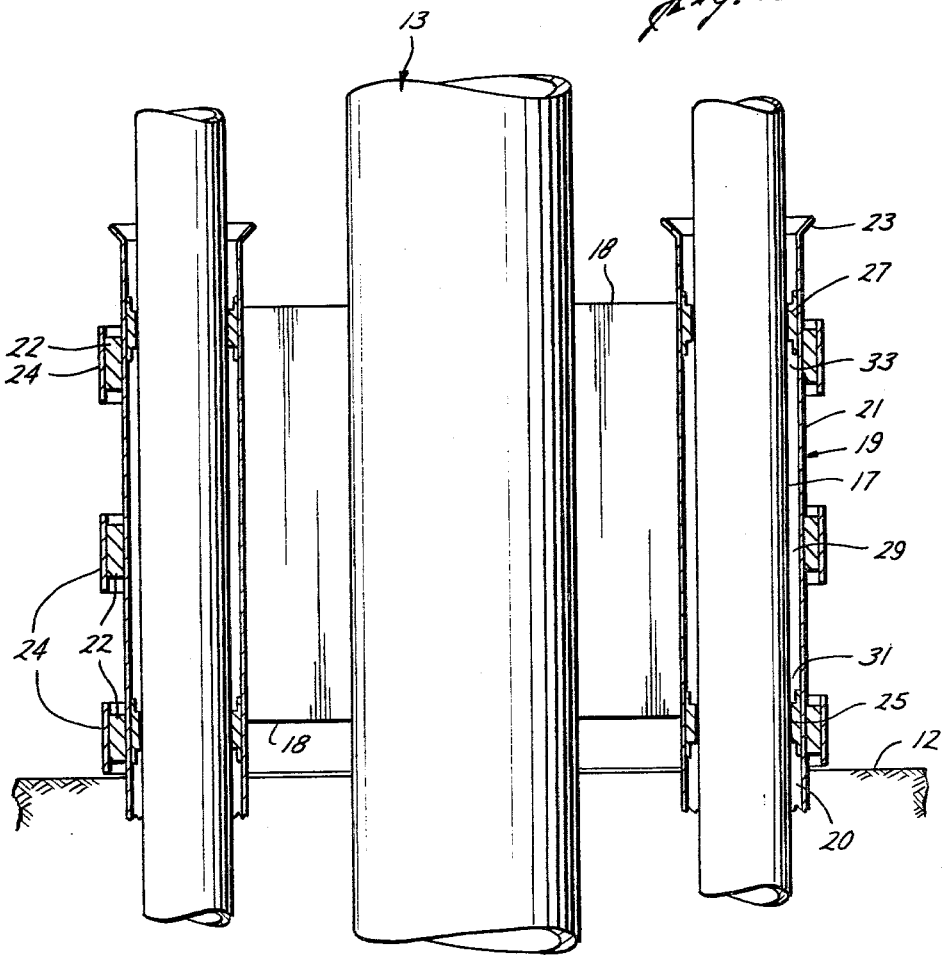
FIG. 2 is a side cross-sectional view of one of the legs of FIG. 1 taken along section lines 2—2 of FIG. 1.
Figure 3:
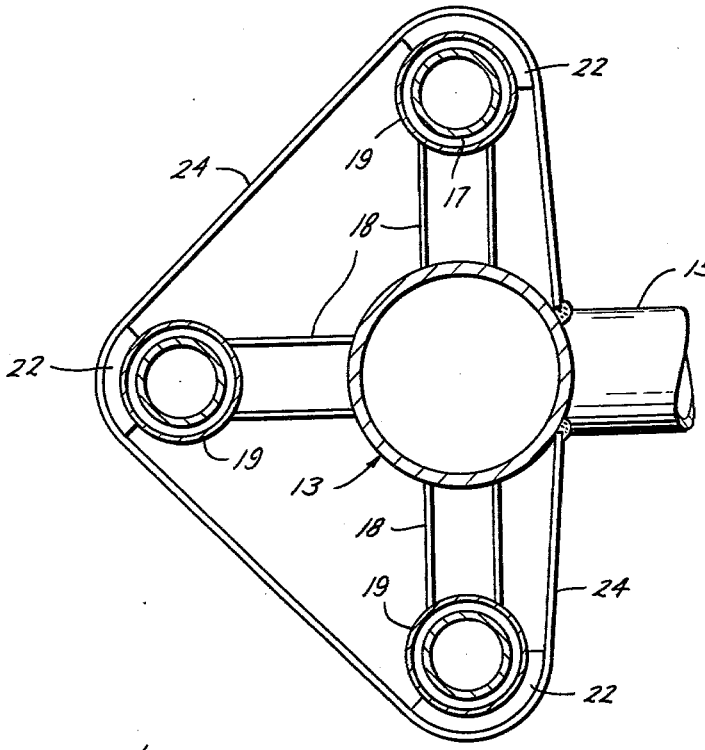
FIG. 3 is a top cross-sectional view of the legs of FIG. 2 taken along section lines 3—3 of FIG. 1.

A typical deep water offshore structure 10, such as is used in the oil and gas industry for offshore drilling and production, is shown in FIGS. 1–3. The structure 10 as shown is only the base portion which is being installed on the sea bed 12, prior to providing the base portion with the usual platform and superstructure (not shown). The structure 10 includes a plurality of supporting legs 11, each in the form of a tubular jacket 13 which extends downwardly from above the water line 14 into the sea bed 12. The several leg jackets are secured together by cross members 15 and diagonals 16 in a conventional manner. As is known, the sea bed 12 is usually comparatively soft and porous, and in many instances the structure 10 will sink of its own weight until the jackets 13 sink many feet, such as, for example thirty feet, into the sea bed. Each jacket 13 is connected by shear plates 18 to pin tiles 19 by welding or other means well known in the art prior to placing jacket 13 on the sea bottom 12. Pin piles 19 have a jacket 21 (FIG. 2) and may have a funnel top 23 with upper open end 30. Jackets 21 inlude flanges 22 mounted on the exterior of jackets 21. Flanges 22 are mounted on jacket 21 by welding or other suitable means well known in the art. Bands 24 are connected by tension or welding or other suitable means to pin tiles 19. Bands 24 are also connected by welding or other means to tubular jackets 13. Pin piles 19 do not usually extend to the surface 14 of the water after the structure 10 is set on the bottom 12.

When the structure 10 is properly placed, pilings 17 are driven through the jackets 21 into the sea bed, usually to the point of refusal, to provide a final support for the platform. As shown, the pilings 17 are normally of tubular steel, and are usually of at least one pipe size smaller than the size of the jackets 21, so that an annular space 20 exists between each piling and its surrounding jacket. The annular space 20 is not, of course, uniform, since no means are used to center the piling in the jacket. On the average, however, the annulus will have a radial thickness of from one inch to two and one-half inches depending upon the size of the installation. A lower packer 25 and an upper packer 27 are located within each annular space 20. Packers 25, 27 are usually of the inflatable type, such as Lynes Types "A" and "SR" manufactured by Lynes Construction Systems Division (Houston, Texas) of Baker Oil Tools, Inc. Each set of packers 25, 27, when set by inflation, usually provide a pressure tight seal to the piling 17 and the jacket 21 at the lower portion 31 and upper portion 33 of annular space 20, thus forming annular chamber 29. When the packers 25, 27 provide a pressure tight seal, annular chamber 29 must be filled with grouting material to attain leg rigidity sufficient to withstand tides, storms, ocean currents and the like and also to protect the piling 17 and the inside of the jacket 21 against corrosion by sea water.

Figure 5:
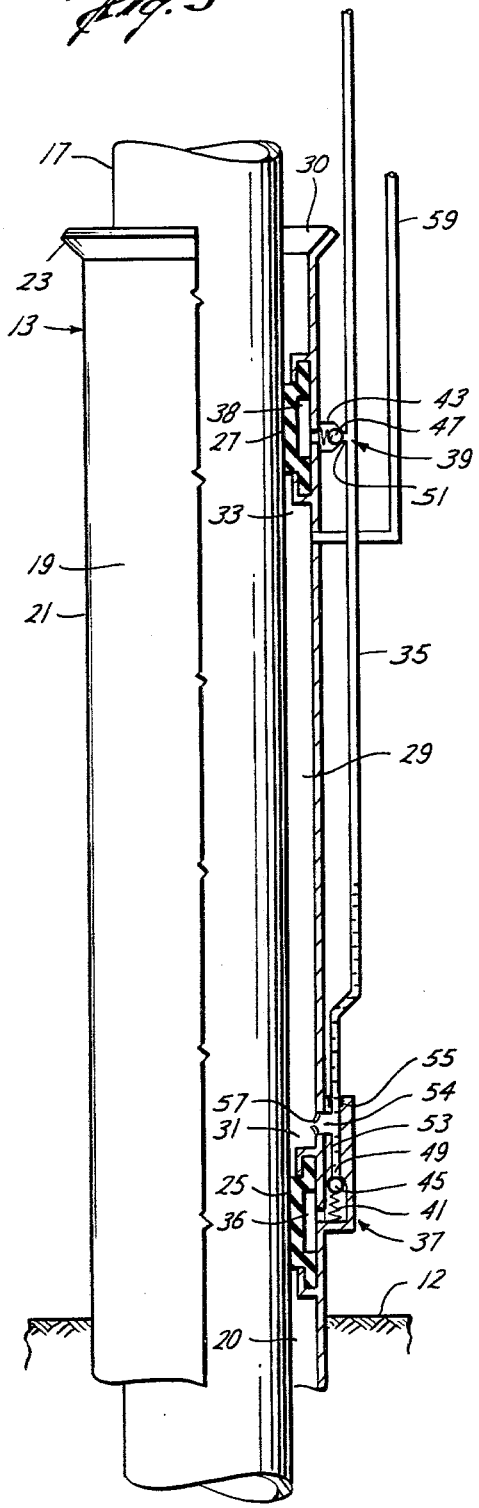
FIG. 5 is an enlarged vertical section view of one of the pin piles of the structure of FIG. 1, showing the method step of expelling water from the annular chamber between the jacket and the pile, the chamber being bounded at its upper and lower ends by packers.

A more detailed view of the structure of pin piles 19 is given in FIG. 5. Each pin pile 19 includes a pipe 35 in fluid communication with the interiors 36, 38 of packers 25, 27 respectively through check valves 37, 39 respectively. Pipe 35 is connected to check valve 37 through chamber 53. Check valves 37, 39 include springs 41, 43 respectively, supporting balls 45, 47 respectively, against orifices 49, 51 respectively.

Chamber 53 includes seal 55 sealing the section of pipe 35 extending upwardly from chamber 53 to the upper end of chamber 53. Chamber 53 further includes orifice 54 and grout shear plug 57 which extends over orifice 54. The bond of grout shear plug 57 to the interior of orifice 54 may be of any suitable material capable of shearing from the interior at a predetermined differential pressure between annular chamber 29 and chamber 53 above that needed to set packers 25, 27, such as, for example, in the range of 250 to 800 psi.

Each pin tile 19 further includes a pipe 59 in fluid flow communication with annular chamber 29 in the upper portion 33 of annular space 20.

Pipes 35, 59 extend upwardly from pin piles 19 to the surface 14 of the water where they are connected to a suitable source 38 (FIG. 4) of air gas grout, and packer inflating fluid.

Figure 4:
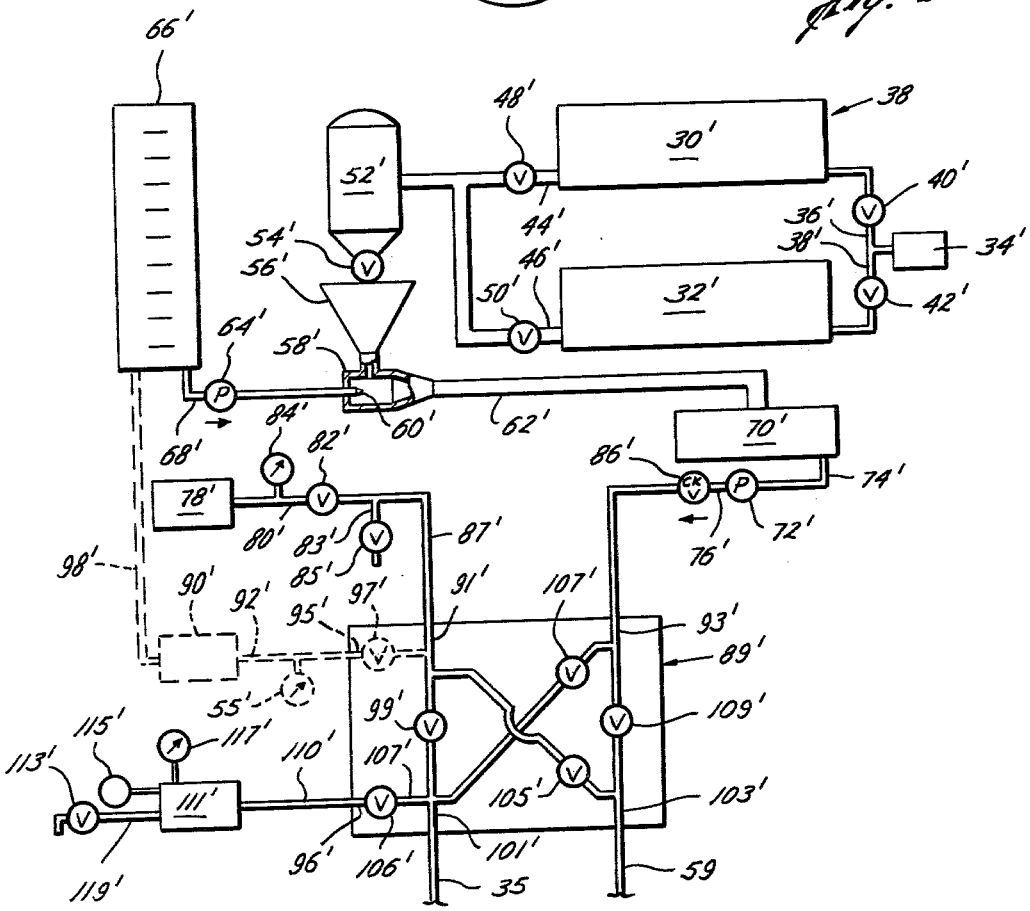
FIG. 4 is a semi-schematic view of apparatus suitable for practicing the preferred embodiment of the method of the invention.

One form of apparatus 38 which has been found suitable for performing the method of this invention is shown in somewhat schematic form in FIG. 4. In this structure two pressure tanks 30', 32' are provided for storage of dry cement. These pressure tanks 30', 32' may, for example, be of the type provided with an air slide bottom, as shown in U.S. Pat. No. 2,609,125 to Schemm or as shown in U.S. Pat. No. 2,934,223 to Scruby et al. In such structure, dry cement is put into the tanks and lies on a porous sloped bottom, and air flowing through the bottom fluidizes the material in the tank to cause it to flow down the slope. In the structure shown, air for such fluidizing is provided by a low pressure air compressor 34' from which air passes through conduit 36', 38' to tanks 30', 32' respectively. Valves 40', 42' are provided to control flow to one or the other of the tanks 30', 32'.

Fluidized cement is carried from the pressure tanks 30', 32' through conduits 44', 46'. Flow through conduits 44', 46' is controlled by valves 48', 50'. The fluidized cement flows from one of the tanks 30', 32' at a time to a surge tank 52' provided with a suitable dry material valve 54' at its lower end. The valve may, for example, be of the type shown in U.S. Pat. No. 2,858,966 to Pfening. When the valve 54' is opened the dry cement falls into a hopper 56' which is connected at its lower end to a mixing chamber 58'. A nozzle 60' extends into the mixing chamber, perpendicular to the outlet of the hopper 56' and coaxially with a mixed cement line 62'. Water is provided to the nozzle 60' by means of a suitable pump 64' which takes suction from a water storage tank 66' through a water line 68'. The water tank may be provided with any convenient gauge so that the amount of water used can be accurately determined.

It will be appreciated that cement falling from the hopper 56' into the mixing chamber 58' is thoroughly admixed into water sprayed from the nozzle 60'. The mixture passes through the line 62' into a slurry tub 70'. A suitable pump 72' takes suction from the slurry tub 70' through a line 74' and pumps the fluid grouting material into manifold 89' through a pipe or hose 76', which is provided with a check valve 86' to allow flow only toward the manifold 89'. Centrifugal pumps are satisfactory in many instances, but where high pressure is required, as in deep water installations, a reciprocating pump may be more desirable.

To provide high pressure, high volume gas for expelling water from the annulus and for the grouting operation, a high pressure, high volume air compressor 78' is provided. Air is usually used for the gas. The air compressor 78' should have an outlet pressure and flows sufficient to force water from annular chamber 29 located hundreds of feet below the surface 14 of the water through pipes 35 or 59 to the surface 14, such as, for example, outlet pressures of 200 to 600 with volumes of 500 to 2500 c.f.m.

Air compressor 78' provides air through a conduit 80', fitted with a suitable valve 82', a pressure gauge 84', and a bleed line 83' having a valve 85' therein. Valve 82' permits the flow of air into conduit 87' to manifold 89'. The pressure gauge 84' is preferably one which reads in feet of sea water, for a purpose which will hereinafter be explained.

The inflation of packers 25, 27 with air as the inflating fluid, such as air from conduit 87', is well known in the art. However, should liquid or other inflating fluid, such as, for example, water, be desired, conduit 98' may be provided to connect water tank 66' with booster pump 90'. The outlet of booster pump 90' is connected to manifold 89' by conduit 92' with pressure gauge 55' to indicate fluid pressure.

Liquid receiving tank 111' is also connected by pipe 110' to manifold 89'. Tank 111' includes pressure gauge 117', level gauge 115' and drain valve 113'. Drain valve 113' is connected to tank 111' by pipe 119'.

Manifold 89' includes conduits and pipes 91', 93', 95', 96', connecting manifold 89' to conduit 87', pipe 76', conduit 92', and pipe 110' respectively. Manifold 89' also includes outlet pipes 101' and 103'. Valve 97', 99', 105', 107', 109', and 106' connect conduit and pipe 95', 91', 91', 93', 93', 96' respectively to conduit and pipe 91', 101', 103', 101', 103', 107' respectively. Outlet pipes 101', 103' may be connected to a set of the pipes 35, 59 respectively. Conduit 107' is connected to conduit 101'.

In the discussion infra of the method for filling the annular chambers 29 with fluid grouting material, only the filling of a single annular chamber 29 will be discussed. However, several or all of the annular chambers 29 may be set simultaneously or sequentially without departing from the spirit of the invention.

In the practice of the preferred embodiment of the method of this invention, the packers 25, 27 are set by inflating them through fluid from pipe 35. Inflating fluid under sufficient pressure to overcome the spring pressure of check valves 37, 39 is introduced by the appropriate valve setting into into conduit 91' of manifold 89' from either conduit 92' or conduit 87'. Valve 99' permits the flow of the inflating fluid from conduit 91' to outlet conduit 101' and thence through pipe 35. The grout shear plug 57 prevents fluid communication between chamber 53 and annular chamber 29 through orifice 54 while the packers 25, 27 are being set. The inflating fluid is usually introduced to slowly pressure up the interiors 36, 38 of packers 25, 27 respectively. After the packers 25, 27 seal against piling 17, the fluid inflate pressure is raised until a differential pressure (the difference in pressure between the pressure inside pipe 35 and the pressure on the lower portion 31 of annular space 29) is reached sufficient to shear the plug 57 from orifice 54, such as in the range of 250 to 800 psi. At this pressure, the shear plug 57 will shear loose from orifice 54. After the plug 57 is sheared, fluid communication between pipe 35 and annular chamber 29 through orifice 54 will occur. This will be indicated by fluid circulation between pipes 35 and 59. A sudden drop in pressure may also be detected by gauge 55'. The drop in pressure will cause check valves 37, 39 to close, trapping inflation fluid under pressure in the interiors 36, 38 of packers 25, 27, thus setting the packer 25, 27. Should the pressure fail to drop or circulation appear, the lower packer 25 has probably failed to form a seal with jacket 21. Filling of annular space 20 through pipe 59 under such circumstances is discussed infra. Should the pressure of inflate fluid fail to rise beyond the back pressure of check valves 37, 39, the upper packer 27 has probably failed to form a seal with jacket 21. Filling of annular space 20 through pipe 59 under such circumstances is discussed infra.

After packers 25, 27 are detected as set, an attempt is made to expel water trapped in the annular chamber 29. Valves 82', 106' are opened; valves 95', 99' 107', 109' and 106' are closed. Air is then forced from compressor 78' through pipe 59 to expel water trapped in the annular chamber 29 out through orifice 54 and through pipe 35. As the air is introduced into annular chamber 29, the amount of water flowing through pipe 35 may be measured through the level gauge 115' of receiving tank 111' to test the integrity of packer 27. If little or no water is expelled from pipe 35, packer 27 is not forming a seal with piling 17. If an amount of water corresponding to a significant portion of the volume of water that should be contained in annular chamber 29 is entrained by the large volume of air and conveyed to tank 111', packer 27 is sealing against piling 17. Alternately pressure gauge 84' may be monitored in feet of sea water to determine if a pressure exists in the annular chamber 29 sufficient to overcome the hydrostatic head pressure at lower portion 31. It is therefore convenient for pressure gauge 84' to have a scale graduated in feet of water. Care must be taken to maintain the pressure in annular chamber 29 at the approximate pressure of the water previously in the chamber 29 during the expelling of water from chamber 29. A sudden drop in pressure might cause collapse of either or both packers 28, 27 and also might cause collapse of jacket 21 or piling 17.

The air pressure on the downstream side of the water may be controlled to maintain a desired differential pressure between the outlet of compressor 78' and the pressure in tank 111' if desired. This pressure may be controlled by manipulating valve 113' or another valve (not shown) attached to the upper part of tank 111' if the dual use of valve 113' for drainage and air venting makes the use of a single valve inappropriate or if water interferes with the venting.

If packer 27 is found to be sealing against piling 17 (FIG. 5), the method further includes the step of attempting to continue to raise the pressure in annular chamber 29 by introducing additional air through pipe 59. If the introduction of air through pipe 59 fails to cause the pressure to rise in annular chamber 29 as measured by gauge 84', then packer 25 is not sealing against piling 17. If the introduction of air through pipe 59 causes the pressure to rise in annular chamber 29, then packer 25 is sealing against piling 17.

Figure 6:
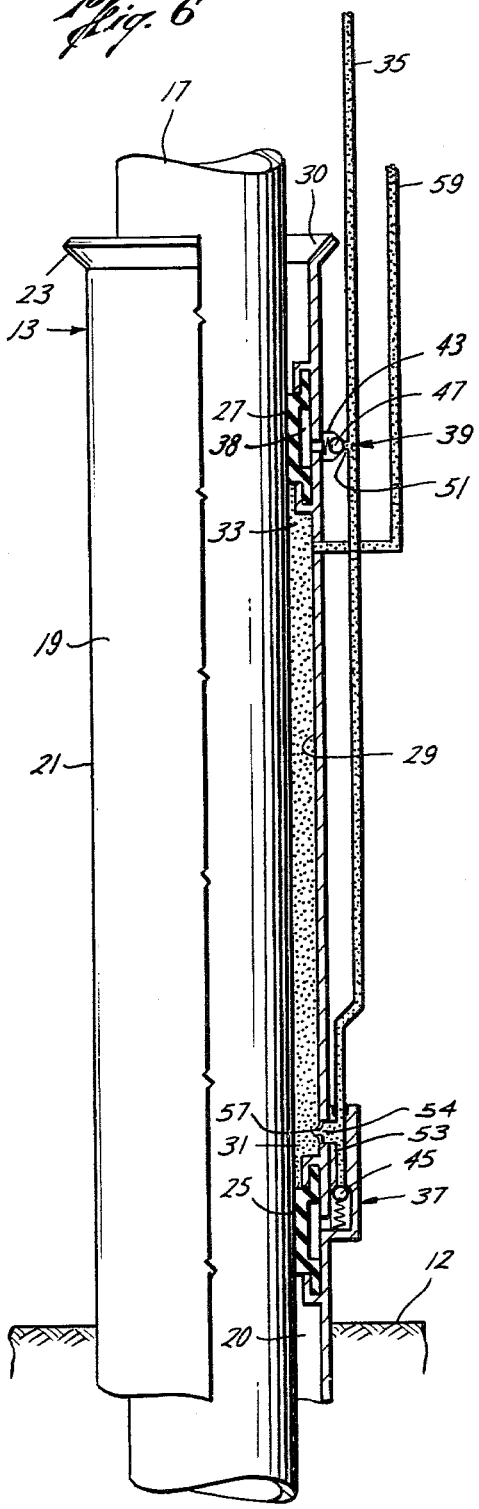
FIG. 6 is an enlarged vertical sectional view of one of the pin piles of the structure of FIG. 1, showing the grouting material in place.

If both packers 25, 27 are sealing against piling 17, then the method includes the steps of:

(1) Bleeding air from annular chamber 29 through pipe 59 to slowly lower the pressure in annular chamber 29 to a value substantially equal to the external hydrostatic head pressure on annular chamber 29 (the sudden reduction of air pressure in line 59 before the introduction of grout into annular chamber 29 to compensate for the reduction might cause damage to either or both packers 25, 27 or piling 17 or jacket 21 because of the large differential pressure between annular chamber 29 and the hydrostatic head);

(2) Opening valve 107' and closing valve 106';

(3) Flowing fluid grouting material into annular chamber 29 through pipe 76', manifold 89', and pipe 35 until annular chamber 29 is filled and grout returns to the water surface 14 through pipe 59. Detection of the return may be made by sight glass, the outlet of valve 85' or other suitable means. The fluid grouting material is typically pumped into annular chamber 29 while gradually releasing the air in annular chamber 29 through pipe 59 to control the pressure in annular chamber 29 at approximately the pressure of the external hydrostatic head pressure on annular chamber 29;

(4) After grouting material has filled annular chamber 29 and returns through pipe 59 (FIG. 6), additional air is introduced to cause pressure to be exerted on the grouting material in excess of the external hydrostatic head pressure on annular chamber 29. This causes a better bond of the grouting material with piling 17 and jacket 21.

Figure 7:
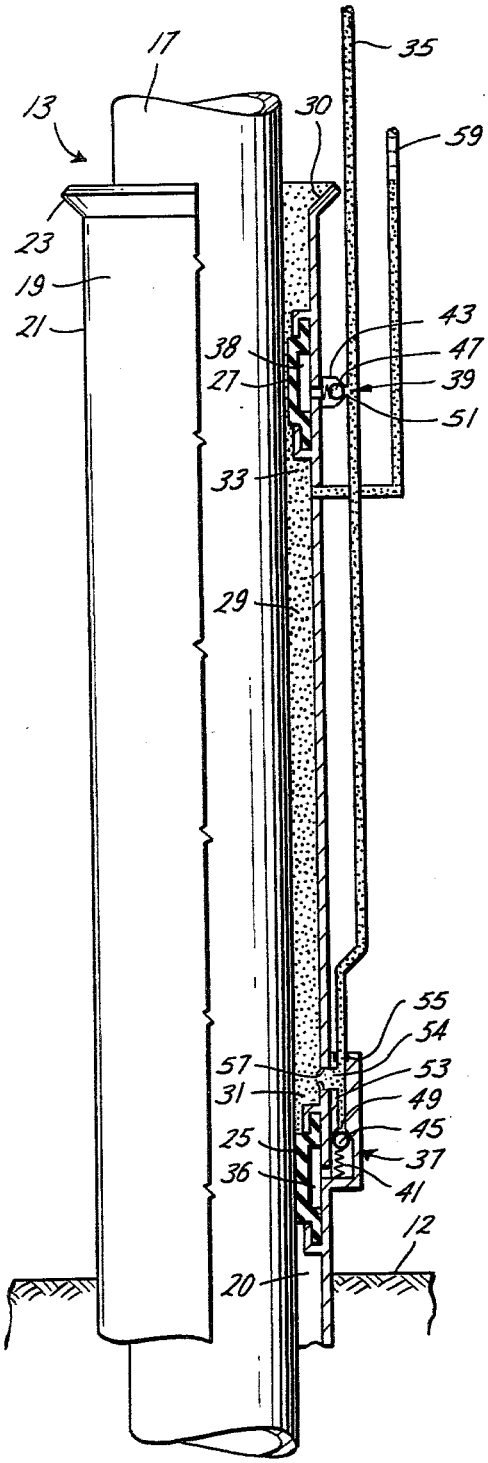
FIG. 7 is an enlarged vertical sectional view of one of the pin piles of the structure of FIG. 1, showing a failed upper packer and grouting material in place.

If packer 27 is found not to be sealing against piling 17 (FIG. 7) or jacket 21, instead of using the above steps, the method includes the step of employing conventional grouting techniques to seal annulus 20. See, for example, U.S. Pat. No. 3,209,544. Valves 106', 97', 99', 105', and 109' are closed. Valve 107' is opened. Grouting material is pumped through pipe 35 into annulus 20 through orifice 54. A television camera, diver or other means well known in the art may be employed to monitor the upper opening 30 of annulus 20 to detect the emergence of the grouting material as annulus 20 fills with grout. As an alternate to monitoring of upper opening 30 for grout returns, after annulus 20 is filled, a volume of grouting material substantially greater than the theoretical volume of annulus 20 may be introduced into annulus 20 through pipe 35 and permitted sufficient time to set. Then, after closing valve 107' and opening valve 105', air can then be introduced into line 59. If a pressure of the air is greater than the hydrostatic head, the annulus 20 may be presumed to be substantially full of grout. Also, pipe 59 may be used in the same manner to introduce the grouting material into the annulus, especially if grout shear plug 57 has not sheared because packer 27 is not sealing against jacket 21.

Figure 8:
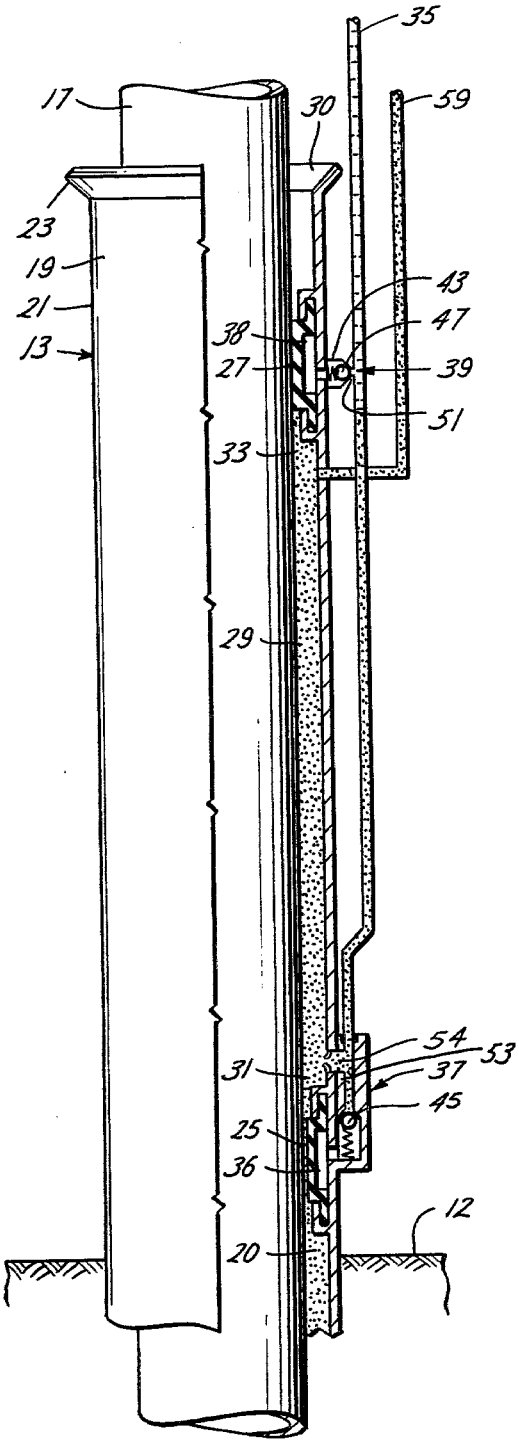
FIG. 8 is an enlarged vertical sectional view of one of the pin piles of the structure of FIG. 1, showing a failed lower packer and grouting material in place.

If packer 25 is found not to be sealing against piling 17 (FIG. 8) of jacket 21, the method includes the step of employing pressure grouting techniques to seal annulus 20. See, for example, U.S. Pat. No. Re.28,232. Valves 97', 99' and 107' are closed. Valves 105', 106' and 109' are opened. Air is then introduced into pipe 59 to force the water out of annulus 20 through 35 to tank 111'. Valve 106' is closed after the water is expelled. Alternatively, valve 106' may be closed and the water forced out the bottom of annulus 20 as disclosed in U.S. Pat. No. Re.28,232. Grouting material is then introduced through pipe 59 while maintaining pressure in annulus 20 through pipe 59 approximately equal to the hydrostatic head pressure on annulus 20. However, because only one line is available for both maintaining air pressure and introducing grout, the method of introducing air and grout is somewhat dependent on the manifold 89'. If grout and air cannot be introduced simultaneously, grouting of the annulus 20 may be accomplished by alternately:

(1) introducing grout, and (2) introducing or venting air in pipe 59 to maintain hydrostatic pressure until the portion of annulus 20 below the lower side of packing 25 is substantially full of grout and sets.

Also, alternately, after air is introduced into annulus 20, quick setting cement or other suitable grouting material may be introduced into the lower portion of annulus 20 through pipe 59 or 35 to form a plug which may be permitted to set while maintaining air pressure through pipe 59. If grouting material and air are both introduced through pipe 59, the formation of a grout plug at the bottom of annulus 20, in a combination with packer 27 sealing against piling 17, permits the use of the steps set out for packers 25, 27 both sealing against piling 17. However, if pipe 35 is used to introduce grout into annulus 20 to form the grout plug or if plug 57 has not sheared, then pipe 35 probably will be unable to pass further grout after the initial grout plug is formed. In this instance, pipe 59 would be used to supply air to maintain pressure while permitting the subsequent flow of grouting material into annulus 20 as previously described in this paragraph.

Although the apparatus and method described in detail supra has been found to be most satisfactory and preferred, many variations in structure and method are possible. For example, any manifold arrangement permitting either air or grouting material to flow in pipe 59 and grouting material to flow in pipe 35 may be used. Also any gas may be used. Moreover, a manifold may be provided for each set of pipes 35, 59 or the pipes may alternately be connected to the manifold.

The above are exemplary of the possible changes or variations.

Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

What is claimed as invention is:

1. A method of grouting an offshore structure having at least one submerged supporting member, the member including a substantially vertically extending tubular jacket and a piling in said jacket having an outside diameter smaller than the inside diameter of the jacket whereby a space is formed between the inside of the jacket and said pilings; said space having a packer at its upper end and a packer at its lower end wherein the space between the packers is initially filled with water and wherein a first fluid conductive line extends from the surface of the water to and in fluid flow communication with the upper end of the jacket below the upper packer and a second fluid conductive line extends from the surface of the water to and in fluid flow communication with the lower end of the jacket above the lower packer, said method comprising the steps of:

A. setting the upper and lower packers;

B. testing the upper packer through the use of compressed fluid supplied through one of the lines to determine if the upper packer is sealed against the piling.

2. The method of claim 1 wherein there is included the additional step of:

C. testing the lower packer through the use of additional compressed fluid supplied through one of the lines to determine if the lower packer is sealed against the piling.

3. The method of claim 2 wherein the testing of the lower packer is done through the use of the first line.

4. The method of claim 3 wherein the compressed fluid includes a compressed gas.

5. The method of claim 4 wherein the test of Step C of claim 2 indicates the lower packer is not sealed against the piling and wherein there is further included the steps of:

D. introducing additional compressed gas into the annular space through the first line so as to expel water from the annular space through the lower end of the jacket;

E. introducing fluid grouting material into the annular space through the first line after water has been expelled from the space in Step D.

6. The method of claim 5 wherein there is further included the step of

F. permitting the grouting material to set.

7. The method of claim 4 wherein the test of step C of claim 2 indicates the lower packer is not sealed against the piling and wherein there is further included the steps of:

D. introducing additional compressed gas into the annular space through the first line so as to expel water from the annular space through the lower end of the jacket;

E. introducing sufficient fluid grouting material into the annular space through the first line after water has been expelled from the annular space in Step D to form a plug of grouting material below the second line;

F. permitting the plug of grouting material to set.

8. The method of claim 7 wherein there is further included the step of:

G. filling the annular space above the plug with fluid grouting material through the second line.

9. The method of claim 4 wherein the test of step C of claim 2 indicates the lower packer is not sealed against the piling and wherein there is further included the steps of:

D. introducing addition compressed gas into the annular space through the first line so as to expel water from the annular space through the lower end of the jacket;

E. introducing fluid grouting material into the annular space through the second line after water has been expelled from the space in Step D.

10. The method of claim 9 wherein there is further included the step of:

F. permitting the grouting material to set.

11. The method of claim 4 wherein the test of step C of claim 2 indicates the lower packer is not sealed against the piling and wherein there is further included the steps of:

D. introducing additional compressed gas into the annular space through the first line so as to expel water from the annular space through the lower end of the jacket;

E. introducing sufficient fluid grouting material into the annular space through the second line after water has been expelled from the annular space in Step D to form a plug of grouting material below the second line;

F. permitting the plug of grouting material to set.

12. The method of claim 11 wherein there is further included the step of:

G. filling the annular space above the plug with fluid material through the first line while maintaining sufficient gas pressure through the first line to prevent damage to the packers piling or jacket.

13. The method of claim 12 wherein the step of maintaining sufficient gas pressure includes the step of gradually reducing gas pressure while flowing fluid grouting material into the annular space to compensate for the pressure head exerted by the grouting material.

14. The method of claim 13 wherein there is further included the steps of detecting grouting material in the first line and releasing gas pressure after the grouting material is detected.

15. The method of claim 3 wherein there is included the additional step of:

D. filling the annular space above the lower packer with fluid grouting material through the second line.

16. The method of claim 7 wherein there is included the additional step after Step D of applying sufficient fluid pressure to the fluid grout material in the annular space between the packers to increase the bond between the grouting material and the pile as the grouting material hardens.

17. The method of claim 3 wherein the compressed fluid includes a gas, and wherein Step B includes the step of applying sufficient gas to force substantially all of the liquid in the annular space out the second line; and wherein there is included the step of flowing fluid grouting material down through the second line while maintaining sufficient gas pressure through the first line to prevent damage to the packers, piling or jacket.

18. The method of claim 17 wherein said grouting material is permitted to set.

19. The method of claim 17 wherein the step of maintaining sufficient gas pressure includes the step of gradually reducing gas pressure while flowing fluid grouting material into the annular space to compensate for the pressure head exerted by the grouting material.

20. The method of claim 19 wherein there is further included the steps of detecting grouting material in the first line and releasing gas pressure after the grouting material is detected.

21. The method of claim 1 wherein such fluid includes a gas.

22. The method of claim 21 wherein such gas includes air.

23. The method of claim 1 wherein there is included the additional step of:

C. filling the annular space above the lower packer with fluid grouting material through the first line.

24. The method of claim 1 wherein there is included the additional step of:

filling a portion of the annular space above the lower packer with fluid grouting through the second line.

25. The method of claim 1 wherein the testing of the upper packer in Step B is done through the use of the first line.

26. Apparatus for grouting an offshore structure with fluid grouting material, the structure having at least one submerged supporting member, the member including a substantially vertically extending tubular jacket and a piling in said jacket having an outside smaller than the inside diameter of the jacket whereby a space is formed between the inside of the jacket and said pilings; said space having a packer at its upper end and a packer at its lower end wherein the space between the packers is intially filled with water and wherein a first fluid conductive line extends from the surface of the water to and in fluid flow communication with the upper end of the jacket below the upper packer and a second fluid conductive line extends from the surface of the water to and in fluid flow communication with the lower end of the jacket above the lower packer and one of the lines is connected to the packers, comprising:

means associated with the line connected to the packers for setting the upper and lower packers;

means associated with the lines for testing the seal of the packers with the jacket;

means associated with the lines for testing the seal of the upper packer with the piling; and means for filling the space between the packers with the fluid grouting material.

27. The apparatus of claim 26 wherein there is further included means associated with the lines for testing the seal of the lower packer with the piling.

28. A method of grouting an offshore structure having at least one submerged supporting member, the member including a substantially vertically extending tubular jacket and a piling in said jacket having an outside diameter smaller than the inside diameter of the jacket whereby a space is formed between the inside of the jacket and said piling; said space having a packer at its upper end and a packer at its lower end wherein the space between is initially filled with water and wherein a first fluid conductive line extends from the surface of the water to and in fluid flow communication with the lower and upper packers, said method comprising the steps of:

A. setting the upper and lower packers through the first fluid conductive line;

B. testing the seal of the lower packer with the jacket through the use of compressed fluid supplied through the first fluid conductive line.

29. The method of claim 28 wherein there is further included the step of testing the seal of the upper packer with the jacket through the use of compressed fluid supplied through the first fluid conductive line.

30. Apparatus for use with an offshore structure having at least one supporting member, the member including a substantially vertically extending tubular jacket and a piling in the jacket having an outside diameter smaller than the inside diameter of the jacket whereby space is formed between the inside of the jacket and the piling, comprising:

packer means for forming a sealed annular region in the space, the packer means including at least one packer adapted to engage and form a sealing surface with the jacket and the pile;

actuating means for actuating said packer means from the surface of the water;

flow means for providing fluid flow communication between said annular region and the surface of the water; and test means for testing the sealing engagement of said packer means with the jacket and the pile through said flow means.

31. The apparatus of claim 30 wherein said test means includes indicating means located above the surface of the water for indicating the results of said tests of said test means.

32. Apparatus located at the surface of the water for use with a pair of packers located in the annular space between a tubular jacket and a piling telescopically received in the jacket under the water, the packers forming an annular region, to test the seals of the packers with the jacket and the piling after the packers are set and to flow grout into the annular region, the annular region being connected to the surface of the water by first and second fluid conductive pipes, comprising:

supply means for supplying a fluid;

grout means for supplying cementitious material;

connective means for connecting said supply means and said grout means to the first and second fluid conductive pipe including manifold means for selectively routing the fluid and the cementitious material from said supply means and said grout means to the first and second fluid conductive pipe; and monitoring means for monitoring the pressure of the fluid.

33. The apparatus of claim 32 wherein there is further included detection means located at the surface for detecting the filling of the region by the cementitious material.

34. A method of testing and maintaining the integrity of the packers utilized with an offshore structure having at least one submerged supporting member, the member including a substantially vertically extending tubular jacket and a piling in said jacket having an outside diameter smaller than the inside diameter of the jacket whereby a space is formed between the inside of the jacket and said pilings; said space having one of the packers set at its upper end and the other of its packers set at its lower end wherein the space between the packers is initially filled with water and wherein a first fluid conductive line extends from the surface of the water to and in fluid communication with the upper end of the jacket below the upper packer and a second fluid conductive line extends from the surface of the water to and in fluid communication with the lower end of the jacket above the lower packer, said method comprising the steps of:

A. testing line continuity after the packers are set;

B. dewatering the annulus;

C. testing the integrity of the upper packer for grouting by pressuring the annulus through the use of compressed fluid introduced through one of the lines;

D. testing the integrity of the lower packer for grouting by increasing the pressurization of Step C of the annulus through the use of the compressed fluid introduced through one of the lines to a hydrostatic pressure substantially equal to at least the hydrostatic head at the lower packer; and E. maintaining the hydrostatic pressure in the annulus to prevent collapse of the packers during the grouting of the annulus.

35. Apparatus for use with compressed fluid in testing and maintaining the integrity of the packers utilized with an offshore structure having at least one submerged supporting member, the member including a substantially vertically extending tubular jacket and a piling in said jacket having an outside diameter smaller than the inside diameter of the jacket whereby a space is formed between the inside of the jacket and said pilings; said space having one of the packers set at its upper end and the other of its packers set at its lower end wherein the space between the packers is initially filled with water and wherein a first fluid conductive line extends from the surface of the water to and in fluid communication with the upper end of the jacket below the upper packer and a second fluid conductive line extends from the surface of the water to and in fluid communication with the lower end of the jacket above the lower packer, said apparatus comprising:

means for testing line continuity after the packers are set;

means for dewatering the annulus;

means for testing the integrity of the upper packer for grouting by pressuring the annulus through the use of the compressed fluid introduced through one of the lines;

means for testing the integrity of the lower packer for grouting by increasing the pressurization of the annulus through the use of the compressed fluid introduced through one of the lines to a hydrostatic pressure substantially equal to at least the hydrostatic head at the lower packer; and means for maintaining the hydrostatic pressure in the annulus to prevent collapse of the packers during the grouting of the annulus.

* * * * *

UNITED STATES PATENT AND TRADEMARK OFFICE

CERTIFICATE OF CORRECTION

PATENT NO. : 4,184,790

DATED : January 22, 1980

INVENTOR(S) : Max Bassett

It is certified that error appears in the above—identified patent and that said Letters Patent is hereby corrected as shown below:

Column 2, line 32, after "of" insert -- AND --.

Column 3, line 35, change "process" to -- processed --.

Column 4, line 57, change "tiles" to -- piles --.

Column 4, line 60, change "inlude" to --include--.

Column 4, line 65, change "tiles" to -- piles --.

Column 5, line 19, change "provide" to -- provides --.

Column 6, line 41, after "600" insert --p.s.i.--.

Column 7, line 3, after "discussion" italicize -- infra --.

Column 7, line 41, after "discussion" italicize -- infra --.

UNITED STATES PATENT AND TRADEMARK OFFICE

CERTIFICATE OF CORRECTION

PATENT NO. : 4,184,790

DATED : January 22, 1980

INVENTOR(S) : Max Bassett

It is certified that error appears in the above—identified patent and that said Letters Patent is hereby corrected as shown below:

Column 7, line 46, italicize -- infra --.

Column 9, line 59, underline "supra".

Column 11, line 36, before "material" insert -- grouting --.

Column 12, line 20, before "filling" insert -- C. --.

Column 12, line 29, after "outside" insert -- diameter --.

Column 13, line 14, change "piling" to -- pilings --.

Signed and Sealed this

*Second* Day of *February 1982*

[SEAL]

*Attest:*

GERALD J. MOSSINGHOFF

*Attesting Officer*

*Commissioner of Patents and Trademarks*